US007494106B2

(12) United States Patent
Mathis

(10) Patent No.: US 7,494,106 B2
(45) Date of Patent: Feb. 24, 2009

(54) PANEL FOR A ROUND FORM

(75) Inventor: Hugo Mathis, Bregenz (AT)

(73) Assignee: Rund-Stahl-Bau Gesellschaft m.b.H., Fuβach (AT)

( * ) Notice: Subject to any disclaimer, the term of this patent is extended or adjusted under 35 U.S.C. 154(b) by 64 days.

(21) Appl. No.: 11/011,134

(22) Filed: Dec. 15, 2004

(65) Prior Publication Data

US 2005/0127268 A1 Jun. 16, 2005

(30) Foreign Application Priority Data

Dec. 16, 2003 (AT) ..... A 2020/2003

(51) Int. Cl.
*E04G 9/00* (2006.01)
*E04G 17/14* (2006.01)
*E04G 17/04* (2006.01)

(52) U.S. Cl. ..... 249/192; 249/219.2

(58) Field of Classification Search ..... 249/189, 249/190, 191, 192, 193, 194, 196, 33, 40, 249/44, 45, 46, 47, 219.1, 219.2; 52/223.3, 52/223.8, 223.12, 644
See application file for complete search history.

(56) References Cited

U.S. PATENT DOCUMENTS

| | | | | | |
|---|---|---|---|---|---|
| 23,600 | A | * | 4/1859 | Moseleye | 52/643 |
| 1,744,342 | A | * | 1/1930 | Spink | 52/642 |
| 1,899,924 | A | * | 3/1933 | Broda | 52/86 |
| 2,039,398 | A | * | 5/1936 | Dye | 52/730.7 |
| 2,251,578 | A | * | 8/1941 | Rietzke | 52/642 |
| 2,793,720 | A | * | 5/1957 | Hawes | 52/640 |
| 2,918,716 | A | * | 12/1959 | Pratt | 249/192 |
| 3,601,356 | A | * | 8/1971 | Yurick | 249/219.2 |
| 4,173,857 | A | * | 11/1979 | Kosaka | 52/642 |
| 4,185,805 | A | | 1/1980 | Ewing | |
| 4,553,729 | A | * | 11/1985 | Connors | 249/40 |
| 4,577,727 | A | | 3/1986 | Frei | |
| 4,742,985 | A | * | 5/1988 | Mathis | 249/193 |
| 4,915,345 | A | * | 4/1990 | Lehmann | 249/18 |
| 5,029,803 | A | * | 7/1991 | Schworer | 249/47 |
| 5,492,303 | A | * | 2/1996 | Jaruzel | 249/219.1 |
| 5,509,635 | A | * | 4/1996 | Jaruzel | 249/47 |
| 5,857,300 | A | * | 1/1999 | Gates | 52/426 |

FOREIGN PATENT DOCUMENTS

| | | | | |
|---|---|---|---|---|
| DE | 31 12 298 A1 | | 1/1982 | |
| EP | 0 321 006 A | | 6/1989 | |
| FR | 2672921 A1 | * | 8/1992 | 249/33 |
| JP | 1-187262 | * | 7/1989 | 249/40 |
| JP | 5-222838 | * | 8/1993 | 249/219.1 |
| JP | 6-136946 | * | 5/1994 | 249/38 |

* cited by examiner

*Primary Examiner*—Michael Safavi
(74) *Attorney, Agent, or Firm*—Wenderoth, Lind & Ponack, L.L.P.

(57) ABSTRACT

A form panel for a round form comprises a form skin, on a backside of which vertically extending profile rails are disposed, with which horizontally extending curved shaping bars are detachably connected. The shaping bars are each formed by at least two, preferably at least four, cast elements, each of which extends over a large portion of a longitudinal extent of the shaping bars and which are held together by shoes, and, due to a curvature-dependent offset between the cast elements in a longitudinal direction of the shaping bars in each instance at least one, preferably at least two, of the cast elements extend up to a particular front-side end of the shaping bars.

26 Claims, 4 Drawing Sheets

Fig. 5
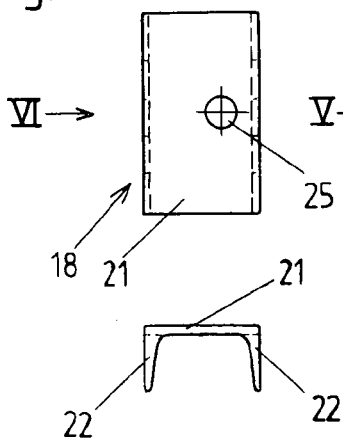
Fig. 6
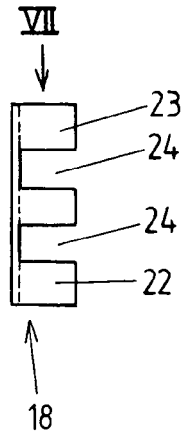
Fig. 7
Fig. 11
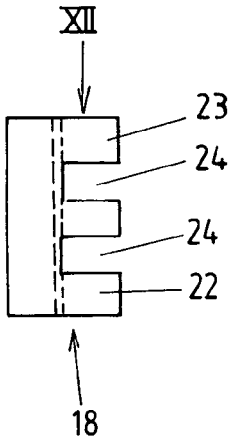
Fig. 8
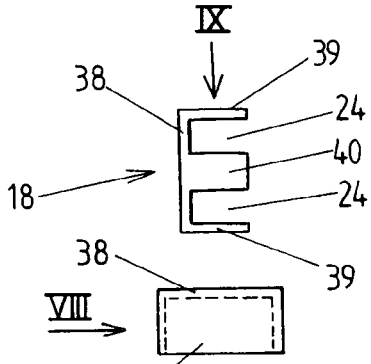
Fig. 9
Fig. 12
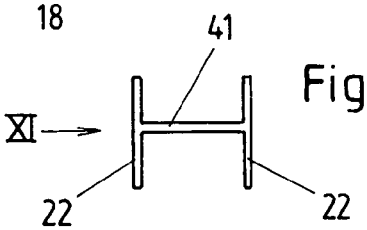
Fig. 10
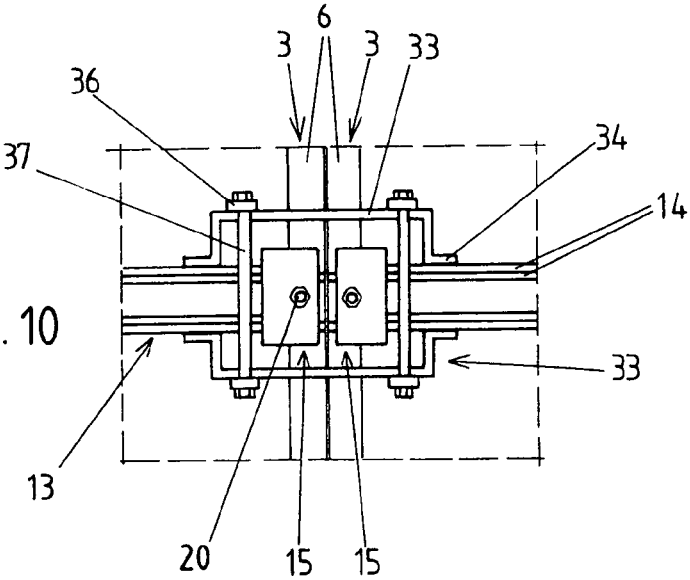

PANEL FOR A ROUND FORM

BACKGROUND OF THE INVENTION a) Field of the Invention

The invention relates to a panel for a round form comprising a form skin, on whose backside vertically extending profile rails are disposed, with which horizontal curved shaping bars are detachably connected.

b) Description of Related Prior Art

Form panels of this type are known. In order to implement one side of the round form (e.g. an outer form) from such panels, several panels of this type, to be arranged next to and/or above one another, are connected with one another. An outer and inner form can herein be developed analogously. In a region between the vertically extending profile sections, concrete pressure is borne by the form skin. Shaping bars, also referred to as anchor rails, determine a curved shape of the panels. Further, these shaping bars conventionally form a bearing surface and abutment for anchors of the form anchored therethrough.

Such form panels are reusable. If herein a radius of curvature of a round form is to be for example smaller than in a preceding application, roundness of dismounted shaping bars is contoured to a required greater curvature by plastic deformation with an appropriate rounding device. Since the shaping bars are disposed radially further inwardly than the form skin, the shaping bars would, after the contouring, project laterally beyond the form skin. The shaping bars are therefore cut correspondingly in order to terminate laterally flush with the form skin. If the form panel is to be applied in a subsequent use for production of a round form with a greater radius of curvature (=smaller curvature), the shaping bars must be replaced since previous shaping bars are now too short.

Apart from round forms, in which shaping bars are deformed by plastic deformation to desired curvature by use of an appropriate rounding device, mechanical systems are also known, in which shaping bars comprise articulations, which can be adjusted according to a desired curvature of a form panel. Of disadvantage herein is complicated structuring and elaborate adjustment work of the articulations.

OBJECT AND SUMMARY OF THE INVENTION

One important object of the invention is providing a form panel of the above described type, which, at simple structuring can be employed for different radii of curvature of a round form without cutting ends of shaping bars, or a replacement of these shaping bars being required.

This is achieved according to the invention through a form panel comprising:

a form skin;

vertically extending profile rails disposed on a backside of the form skin;

horizontally extending curved shaping bars detachably connected with the profile rails, which shaping bars are each formed by at least two continuous cast elements each extending over a large portion of a longitudinal extent of the shaping bars and held together by shoes, wherein in each instance at least one of the cast elements extends up to a particular front-side end of the shaping bars due to a curvature-dependent offset between the cast elements in a longitudinal direction of the shaping bars.

Consequently, according to the invention a one length-adjustable shaping bar is provided. In a case of an inner form a shaping bar can thereby be shortened for a greater curvature and, in a case of a lesser curvature, the shaping bar can be lengthened or, in a case of an outer form, the shaping bar can be lengthened with a greater curvature and shortened with a lesser curvature, such that in each instance the shaping bar terminates at an edge of the form skin. As a function of the curvature, the cast elements are therein offset relative to one another at a variable width. In a case of an inner form, a smallest radius curvature for which the form panel can be employed, is that radius at which the cast elements terminate without offset relative to one another at the side edges of the form skin. In a case of an outer form, this is a case of a greatest radius of curvature for which the form panel can be employed.

Connection of the shaping bars with the vertically extending profile rails preferably takes place via shoes. For this purpose, these shoes can comprise a first clamping part in contact on the profile rail as well as a second clamping part gripping the cast elements on their sides facing away from the form skin, with the clamping parts being braced by a tightening bolt penetrating bores in the clamping parts and in a web, parallel to the form skin, of a particular profile rail.

In a preferred embodiment of the invention above and beneath a longitudinal opening of a shaping bar at least two cast elements, in contact with one another, are available, of which in each instance at least one extends toward a particular front-side end of the shaping bar. Through longitudinal openings can penetrate anchor rods for anchoring of the form.

The cast elements are preferably implemented in the form of plates, and thus have a form of a flat rectangle in cross section. Such flat elements can most readily be contoured with least deformation by use of rollers.

Further advantages and details of the invention will be explained in the following in conjunction with an embodiment example depicted in the drawings. Further objects of the invention are evident therefrom.

BRIEF DESCRIPTION OF THE DRAWINGS

FIGS. 8 and 9 are a side view analogous to FIG. 6 (direction of viewing E in FIG. 9) and a top view analogous to FIG. 7 (direction of viewing F in FIG. 8) of a further embodiment of a clamping part, FIG. 10 is a schematic illustration of a connection unit for connecting shaping bars of two form panels laterally adjoining one another, FIGS. 11 and 12 are a side view analogous to FIG. 6 (direction of viewing G in FIG. 12) and a top view analogous to FIG. 7 (direction of viewing H in FIG. 11) of a further embodiment of a clamping part.

DESCRIPTION OF THE PREFERRED EMBODIMENTS

Figure 1:
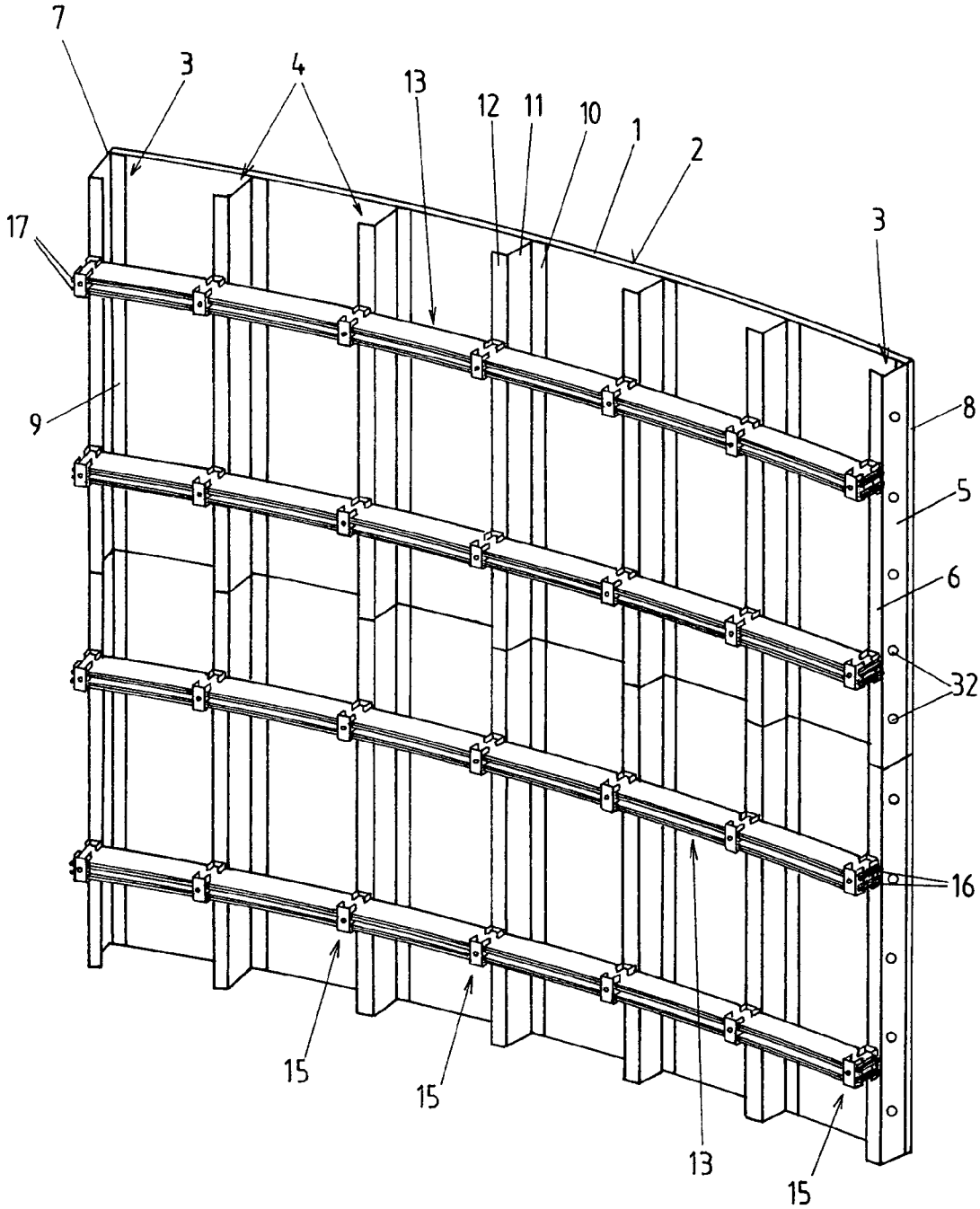
FIG. 1 is a schematic perspective illustration of two form panels according to the invention disposed one above the other.
Figure 2:
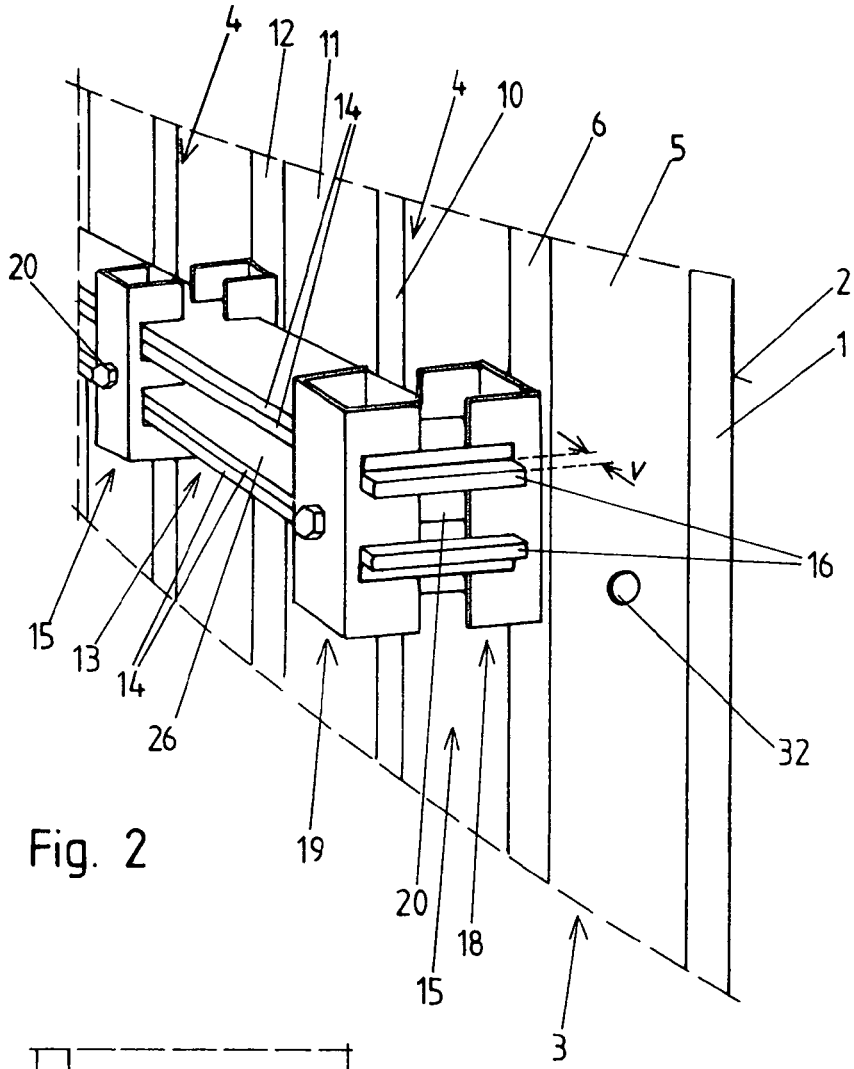
FIG. 2 is an enlarged perspective illustration in greater detail of an edge region of a form panel according to the invention of FIG. 1.

In FIG. 1 two form panels according to the invention of an inner form of a round form are disposed one above the other.

Form panels of an outer form of the round form can be implemented in an analogous manner. A particular form panel comprises a form skin 1, which can be comprised for example of wood (for example laminated wood) and is implemented such that it is preferably continuous over the entire width of a form panel. The form skin 1 can also be implemented to be continuous in height (dimension) or it can be comprised of several adjoining segments. The form skin 1 can, for example, also be formed by a steel plate.

On a backside of the form skin 1, facing away from form surface 2, several vertically extending profile rails 3, 4 are disposed, e.g. bolted on the form skin. Herein two boundary-side profile rails 3 are available, which preferably have a U-form cross section. Each of the open sides of U-form cross sections of the two boundary-side profile rails 3 faces away from an edge of the form panels. The profile rails 3 comprise webs 9, in contact with the backside of the form skin 1 and fastened to the form skin 1, webs 5 extending from webs 9 at an edge and perpendicularly to the form skin 1, and webs 6, extending at ends of webs 5 remote from the form skin 1, and extending from these webs 5 parallel to the form skin 1. The webs 5 perpendicular to the form skin 1 are preferably flush with front-side ends 7, 8 of the form skin 1.

Between the boundary-side profile rails 3 are disposed at a spacing from one another several vertically extending profile rails 4 on the backside of form skin 1. These profile rails 4 are preferably implemented such that they have a Z-form cross section. They are fastened on form skin 1 with webs 10 in contact with the backside of form skin 1. From an edge of each web 10 projects a web 11 perpendicularly with respect to the form skin, and on an end of web 11, remote from the form skin 1, extends a web 12 extending parallel to the form skin 1. Distances between adjacent profile rails 3, 4 are determined by mechanical laws of statics and can be, for example, in a range between 50 cm and 1.5 m.

With the vertically extending profile rails 3, 4 are detachably connected horizontally extending shaping bars 13. The shaping bars 13 are curved in a horizontal direction, whereby a curvature of the form panel is determined in the horizontal direction. By varying a curvature of the shaping bars 13 the curvature of the form panel can be varied.

Figure 3:
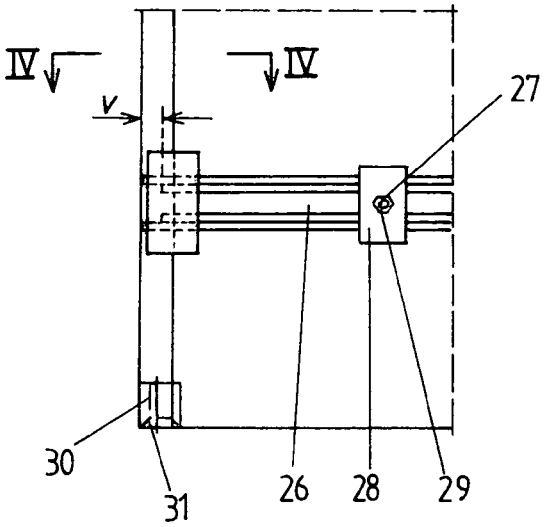
FIG. 3 is a rear view of a lower left corner region of the form panel of FIG. 1.

A more precise implementation of the shaping bars 13 will be explained in the following in conjunction with FIG. 2 to FIG. 9. In this depicted preferred embodiment, each of the shaping bars 13 comprises four cast elements 14 held together by shoes 15. The cast elements 14 are preferably implemented in the form of plates, and thus, viewed in cross section, have the form of a flat rectangle. Each of these cast elements 14 extends over a large portion of a longitudinal extent of the shaping bars, but are at least for all curvatures of the shaping bars 13, except for a greatest (in a case of an inner form) or a least (in a case of an outer form) curvature, designated for this form panel, shorter than a total length of the shaping bar 13. The cast elements 14 are offset relative to one another in the longitudinal direction of the shaping bar 13, and specifically in the depicted arrangement two inner cast elements 14 extend up to a front-side end 16, shown in FIG. 2, of the shaping bar 13 and two other cast elements 14 are spaced apart from this front-side end 16 by offset v. At an opposite front-side end 17 of the shaping bar 13 a condition is precisely reversed (cf. FIG. 3 with a slightly lesser curvature of the shaping bar). In a mounted position according to FIG. 2, this offset v is relatively small. The offset v increases with decreasing curvature of the shaping bar 13. In FIG. 3 a comparatively somewhat greater offset v is depicted.

If all cast elements 14 extend without mutual offset v at both front-side ends of the shaping bars 13, the greatest (in the case of an inner form) or the least (in the case of an outer form) curvature is designated for this form panel.

All of the cast elements 14 have preferably the same length, but they can also be of different lengths.

As stated, the shoes 15 serve for holding together the cast elements 14 and furthermore for preventing them from buckling or being twisted about a horizontal (curved) axis extending in the longitudinal direction of the shaping bar 13. A connection of the shaping bar 13 with the vertically extending profile rails 3, 4, furthermore, preferably takes place via the shoes 15.

In the embodiment according to FIG. 2 to FIG. 7 each particular shoe 15 is formed by two U-shaped clamping parts 18, 19, which are braced with one another by a tightening bolt 20. Each clamping part 18, 19 has a base shank 21 and two side shanks 22. In the side shanks 22 two slots 24 are recessed starting from their free longitudinal edge 23. The slots 24 in the two side shanks 22, viewed in side view (FIG. 6), are congruent. Into the slots 24 are inserted in each instance two adjoining cast elements 14 with their side edges. Into the base shank 21 is a bore 25 at a level between the two slots 24 for passage of the tightening bolt 20. The bore 25 is here closer to one side shank 22 than to the other side shank 22.

One of the two clamping parts 18, 19 is in contact with web 6 of the profile rail 3 or web 12 of profile rail 4. In web 6 or 12 a bore is disposed congruent with bore 25. Into the slots 24 of this clamping part 18 are introduced the one side edges of the cast elements 14. Onto opposite side edges of cast elements 14 is slipped the second clamping part 19. In the depicted embodiment the second clamping part 19 is implemented identically to the clamping part 18, but placed in position rotated by 180 degrees about a horizontal axis and by 180 degrees about a vertical axis relative to the clamping part 18. By virtue of the tightening bolt 20 penetrating web 6 or 12 and the clamping parts 18, 19, the clamping parts 18, 19 are braced against one another and fastened on the profile rail 3 or 4, respectively. The tightening bolts 20 in the depicted embodiment example are formed by bolts in connection with nuts.

At each point of intersection of the shaping bar 13 and the profile rails 3, 4 is preferably provided shoe 15 for holding together and aligning the cast elements 14 and for fastening the shaping bar 13 on the profile rails 3, 4. Into two boundary-side shoes 15 the cast elements 14, spaced apart from a particular front-side end 16, 17, project at a greater or lesser distance and (with smaller curvatures of the form panel in the case of an inner form, or with greater curvatures in the case of an outer form) can also terminate before boundary-side shoe 15. It is in principle also conceivable and possible to provide for this situation a boundary-side shoe with slots 24 implemented in one or both side shanks of the clamping parts 18, 19, wherein a width of the slots corresponds only to a thickness of a single cast element 14.

Figure 4:
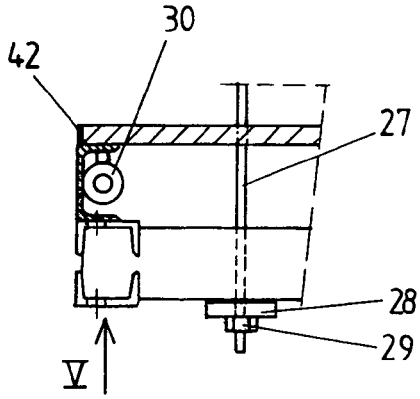
FIG. 4 is a sectional view along line A-A of FIG. 3, FIGS. 5, 6 and 7 are a view (direction of viewing B in FIG. 6), a side view (direction of viewing C in FIG. 5) and a top view (direction of viewing D in FIG. 6) of a clamping part of a shoe for holding together cast elements.

Between the upper cast elements 14, in contact with one another, and the lower cast elements 14, in contact with one another, is located a longitudinal opening 26 of the shaping bar 13. Through it can extend an anchor rod 27 of an anchor, such as is shown in FIG. 3 and FIG. 4. On side edges, facing away from form skin 1, of the cast elements 14 is stayed an anchor plate 28 spanning the cast elements 14. The anchor rod 27 penetrates the anchor plate 28 through a bore in the same and, in proximity of its ends comprises threads, onto which a nut 29 is screwed. In this way the forms disposed on both sides of a wall to be erected can be anchored. A curvature of the form (not shown in the Figures) to be disposed on another side of the wall is a reverse of the form panels shown in FIG. 1 (convex instead of concave). As already cited several times, such a convexly curved form panel can also be implemented in a manner according to the invention, with an offset between the cast elements in this case increasing with increasing curvature.

Connection of several form panels disposed one above the other can take place in a conventional manner, for example by use of tubular pieces 30 disposed at a lower edge of one of the form panels, which tubular pieces 30 are placed onto tubular pieces disposed on an upper end of a lower one of the form panels and are screwed thereto by use of threaded bolts. For centering the tubular pieces 30, conical recesses 31 and corresponding truncated cone-form extensions (not shown in the Figures) to engage into the conical recesses 31 can be provided.

Form panels to be disposed one next to another can be bolted together via their boundary-side profile rails 3, whose webs 5 are in contact on one another. In the webs 5 bore holes 32 can be disposed for passage of threaded bolts.

To achieve continuous rigidity of the shaping bars 13 between form panels laterally adjoining one another, the shaping bars 13 of adjacent form panels can also be connected with one another via connection units. One possible implementation of such a connection unit is shown schematically in FIG. 10. Two bridge-like brackets 33 are provided. Upper bracket 33 is supported with feet 34 on upper sides of the shaping bars 13 of adjacent form panels, and lower bracket 33 on lower sides thereof. In two edge regions of bridge webs 35 of brackets 33 transverse webs 36 are welded thereto, which project beyond them on both sides. In regions in front of and behind the bridge webs 35 the transverse webs 36 include bores, through which extend tightening bolts 37, which brace the two brackets 33 with one another. To the left and the right are provided in each instance two tightening bolts 37 disposed in FIG. 10 one behind the other. Other forms of implementation of connection units for the shaping bars 13 would also be conceivable and possible.

Figure 13:
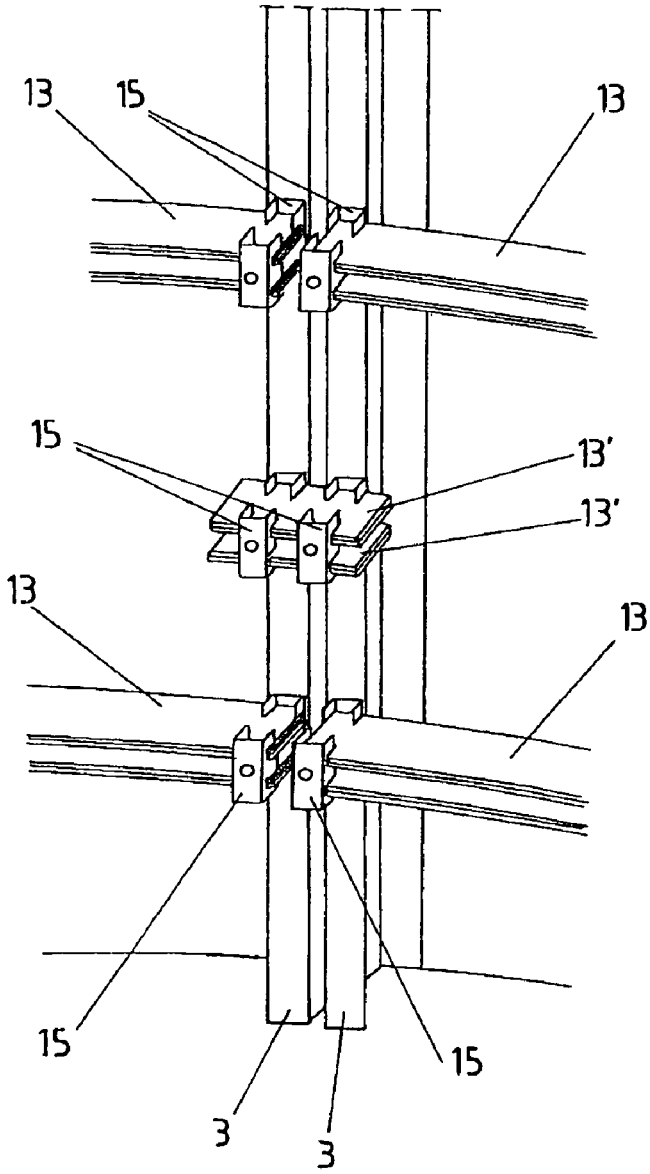
FIG. 13 shows adjoined adjacent panels.

To achieve continuous rigidity between laterally adjoining form panels, it would also be conceivable and possible to dispose at levels between the shaping bars 13 preferably horizontally extending connection rails, which extend over both adjoining form panels and which are connected with at least one of the profile rails 3, 4 of a particular form panel. They are here preferably in any case connected with two boundary-side profile rails 3, adjacent one another, of the two form panels. As shown in FIG. 13, a connection rail including elements 13' could herein be implemented analogously to the shaping bars 13, and their connections with the profile rails 3 and/or 4 could also analogously take place by use of shoes 15.

If the curvature of the form panel is to be changed, the tightening bolts 20 are loosened, whereupon the cast elements 14 can be dismantled. The cast elements 14 are plastically deformed to a desired curvature with a contouring device (by use of appropriate rollers). The shaping bars 13 are subsequently reassembled, with the cast elements 14 being correspondingly offset, and the tightening bolts 20 tightened. In proximity of two front-side ends 16, 17 of the shaping bars 13 at least particular cast elements 14, extending up to these front-side ends 16, 17, should extend through boundary-side shoes 15. The shaping bars 13 can thereby be connected with the boundary-side profile rails 3.

FIG. 8 and FIG. 9 show a modified embodiment example of a clamping part 18 of a shoe. The clamping part 18 comprises a base shank 38 and edge shanks 39 disposed at both ends of the same. In a central region of the base shank 38 side shanks 40 are disposed at its two side edges, which shanks are overlapping in a side view according to FIG. 8. Slots 24 for the insertion of the cast elements 14 are here formed between the edge shanks 39 and the side shanks 40.

A further modified embodiment example of a clamping part 18 of a shoe is depicted in FIG. 11 and FIG. 12. This clamping part is implemented in the form of an H to increase its rigidity, with side shanks 22 and a connection shank 41 including bore 25. From longitudinal edges 23 of the side shanks 22 on one side of the clamping part, again, slots 24 extend for receiving cast elements 14.

At the front-side ends 7, 8 the form skin is preferably provided with an edging protection 42. (FIG. 4). This can be formed for example by a metal web welded onto profile rail 3, which metal web overlaps at the front-side of the form skin 1 preferably comprised of wood, and between this web and the form skin 1 a silicon joint can be implemented.

Various modifications of the depicted embodiment example of the invention are conceivable and possible without going beyond the scope of the invention. For example, more or fewer cast elements 14 can be provided. It would also be conceivable and possible, for example, that the shaping bar 13 is formed by two cast elements 14 implemented such that they are U-shaped in cross section, which are correspondingly offset in the longitudinal direction of the shaping bar 13. In order to make possible an interspace for passage of anchor rods 27, it could also be provided here to place the two U-shaped cast elements with free ends of their side shanks in contact with one another, with the free ends of the side shanks being locally provided with indentations for formation of a longitudinal opening.

It would also be conceivable and possible to implement the boundary-side profile rails 3, instead of in the depicted U-shaped implementation, in the same manner as the profile rails 4, thus as Z-profiles. A web extending spaced apart from the form skin 1 and parallel to the form skin 1 could in this case be disposed for example pointing away in each instance from a side edge of the form panel. A web vertical with respect to the form skin 1, would, in case of the Z-form implementation of the profile rails 4, be spaced apart from the front-side end 7, 8 of the form panel. The shaping bars 13 can extend beyond this web to a particular front-side end 16, 17 and preferably, again, terminate flush therewith. To connect two laterally adjoining form panels, again, connection rails could be provided disposed at levels between the shaping bars 13 and connected with the profile rails 3 and/or 4. In addition, at levels between the shaping bars 13 or the connection rails, respectively, plate-form elements could be bolted onto webs, spaced apart from the form skin 1 and extending parallel thereto, of the adjacent profile rails 4 in order to be able to absorb shearing forces acting in a vertical direction.

U-form or Z-form implementations, other than those depicted and described, of the profile rails 3, 4 would also be conceivable and possible, for example such having the form of an H.

As is evident based on the above description, the scope of the invention is not limited to the depicted embodiment examples, but rather should be determined with reference to the attached claims together with their full range of possible equivalents.

While the above description and the drawings represent the invention, it is obvious to a person skilled in the art that various changes can therein be performed without leaving the true spirit and scope of the invention.

LEGEND TO THE REFERENCE NUMBERS

1 Form skin
2 Form surface

3 Profile rail
4 Profile rail
5 Web
6 Web
7 Front-side end
8 Front-side end
9 Web
10 Web
11 Web
12 Web
13 Shaping bar
14 Continuous cast element
15 Shoe
16 Front-side end
17 Front-side end
18 Clamping part
19 Clamping part
20 Tightening bolt
21 Base shank
22 Side shank
23 Longitudinal edge
24 Slot
25 Bore
26 Longitudinal opening
27 Anchor rod
28 Anchor plate
29 Nut
30 Pipe piece
31 Conical recess
32 Bore hole
33 Bracket
34 Foot
35 Bridge web
36 Transverse web
37 Tightening bolt
38 Base shank
39 Edge Shank
40 Side shank
41 Connection shank
42 Edging protection

The invention claimed is:

1. A panel for a round form, comprising:

a form skin;

vertically extending profile rails on a backside of said form skin;

a shaping bar extending transversely to said vertically extending profile rails and being curved along a longitudinal extent of said shaping bar, said shaping bar being detachably connected to said vertically extending profile rails and including at least two elements, each of said at least two elements being curved along the longitudinal extent of said shaping bar and extending over a large portion of the longitudinal extent of said shaping bar, and shoes for holding together said at least two elements of said shaping bar, each shoe comprising two clamping parts connected to one another via a tightening bolt, wherein said at least two elements of said shaping bar are positioned between said two clamping parts so as to be fixed relative to one another by said clamping parts when said tightening bolt is tightened, and wherein an offset between said at least two elements of said shaping bar in a longitudinal direction of said shaping bar at opposite front-side ends of said shaping bar is adjustable when said tightening bolts of all shoes which hold together the at least two elements of said shaping bar are loosened, wherein by said offset, which depends upon a curvature that the round form is to exhibit in the longitudinal direction of said shaping bar, at least one of said at least two elements defines a first end of said shaping bar in the longitudinal direction of said shaping bar and at least another of said at least two elements defines an opposite second end of said shaping bar in the longitudinal direction of said shaping bar.

2. The panel according to claim 1, wherein said two clamping parts each have a slot such that said at least two elements are positioned between said two clamping parts by being received in said slot of each of said two clamping parts.

3. The panel according to claim 2, wherein said two clamping parts each have a base shank disposed generally parallel to said form skin, with a bore in said base shank of each of said two clamping parts being for passage of said tightening bolt.

4. The panel according to claim 3, wherein said bore in said base shank of said each of said two clamping parts is laterally offset in the longitudinal direction of said shaping bar with respect to a center of said base shank of said each of said two clamping parts.

5. The panel according to claim 1, wherein said shaping bar includes at least two additional elements held together by said shoes, each of said at least two additional elements being curved along the longitudinal extent of said shaping bar and extending over a large portion of the longitudinal extent of said shaping bar, and wherein an offset between said at least two additional elements in a longitudinal direction of said shaping bar depends upon the curvature that the round form is to exhibit in the longitudinal direction of said shaping bar.

6. The panel according to claim 1, wherein said at least two elements contact one another, said at least two additional elements contact one another, and said one of said at least two elements and said one of said at least two additional elements face one another so as to define a longitudinal opening of said shaping bar.

7. The panel according to claim 5, wherein said shaping bar is detachably connected to said vertically extending profile rails via said shoes, respectively.

8. The panel according to claim 1, wherein said vertically extending profile rails comprise two profile rails positioned at ends of said form skin, respectively, with each of said two profile rails having a web extending flush with a respective side edge of said form skin.

9. The panel according to claim 8, wherein said vertically extending profile rails further comprise an additional profile rail positioned between said two profile rails.

10. The panel according to claim 1, wherein said at least two elements are plates.

11. The panel according to claim 1, wherein said at least two elements have identical lengths.

12. The panel according to claim 1, further comprising:

another shaping bar extending transversely to said vertically extending profile rails and being curved along a longitudinal extent of said another shaping bar, said another shaping bar being detachably connected to said vertically extending profile rails and including at least two elements held together by at least one shoe, each of said at least two elements of said another shaping bar being curved along the longitudinal extent of said another shaping bar and extending over a large portion of the longitudinal extent of said another shaping bar, and, by an offset between said at least two elements of said another shaping bar in a longitudinal direction of said another shaping bar, which offset depends upon a curvature that the round form is to exhibit in the longitudinal direction of said another shaping bar, at least one of said at least two elements of said another shaping bar defines a first end of said another shaping bar and at least another of said at least two elements of said another shaping bar defines an opposite second end of said another shaping bar, with said shaping bar and said another shaping bar being spaced from one another in a direction perpendicular to the longitudinal extent of said shaping bar.

13. A system for producing a round form, comprising:

a panel including (i) a form skin, (ii) vertically extending profile rails on a backside of said form skin, (iii) a shaping bar extending transversely to said vertically extending profile rails and being curved along a longitudinal extent of said shaping bar, said shaping bar being detachably connected to said vertically extending profile rails and including at least two elements, each of said at least two elements being curved along the longitudinal extent of said shaping bar and extending over a large portion of the longitudinal extent of said shaping bar, (iv) shoes for holding together said at least two elements of said shaping bar, each shoe comprising two clamping parts connected to one another via a tightening bolt wherein said at least two elements of said shaping bar are positioned between said two clamping parts so as to be fixed relative to one another by said clamping parts when said tightening bolt is tightened, and wherein an offset between said at least two elements of said shaping bar in a longitudinal direction of said shaping bar at opposite front-side ends of said shaping bar is adjustable when said tightening bolts of all shoes which hold together the at least two elements of said shaping bar are loosened, wherein by said offset which depends upon a curvature that the round form is to exhibit in the longitudinal direction of said shaping bar, at least one of said at least two elements defines a first end of said shaping bar in the longitudinal direction of said shaping bar and at least another of said at least two elements defines an opposite second end of said shaping bar in the longitudinal direction of said shaping bar; and a connection rail for adjoining said panel and a laterally adjacent panel by extending across regions of the panel and the laterally adjacent panel and connecting said panel to the laterally adjacent panel.

14. The system according to claim 13, wherein said connection rail comprises at least two elements held together by at least one shoe.

15. The system according to claim 14, wherein said connection rail further comprises at least two additional elements extending over a large portion of a longitudinal extent of the connection rail.

16. The system according to claim 13, wherein said connection rail extends transversely to said vertically extending profile rails.

17. A system for producing a round form, comprising:

a panel including (i) a form skin, (ii) vertically extending profile rails on a backside of said form skin, (iii) a shaping bar extending transversely to said vertically extending profile rails and being curved along a longitudinal extent of said shaping bar, said shaping bar being detachably connected to said vertically extending profile rails and including at least two elements, each of said at least two elements being curved along the longitudinal extent of said shaping bar and extending over a large portion of the longitudinal extent of said shaping bar;

(iv) shoes for holding together said at least two elements of said shaping bar, each shoe comprising two clamping parts connected to one another via a tightening bolt wherein said at least two elements of said shaping bar are positioned between said two clamping parts so as to be fixed relative to one another by said clamping parts when said tightening bolt is tightened, and wherein an offset between said at least two elements of said shaping bar in a longitudinal direction of said shaping bar at opposite front-side ends of said shaping bar is adjustable when said tightening bolts of all shoes which hold together the at least two elements of said shaping bar are loosened, wherein by said offset, which depends upon a curvature that the round form is to exhibit in the longitudinal direction of said shaping bar, at least one of said at least two elements defines a first end of said shaping bar in the longitudinal direction of said shaping bar and at least another of said at least two elements defines an opposite second end of said shaping bar in the longitudinal direction of said shaping bar; and a connection unit for adjoining said panel to a laterally adjacent panel by connecting said shaping bar to a shaping bar of the laterally adjacent panel.

18. The system according to claim 17, wherein said connection unit comprises brackets to be braced, by at least one tightening bolt, in opposite directions against said shaping bar and the shaping bar of the laterally adjacent panel.

19. A panel for a round form comprising:

a form skin;

vertically extending profile rails on a backside of said form skin; and a shaping bar extending transversely to all of said vertically extending profile rails on said backside of said form skin and being curved along a longitudinal extent of said shaping bar, said shaping bar being detachably connected to at least one of said vertically extending profile rails and including at least two elements held together by at least one shoe, each of said at least two elements being curved along the longitudinal extent of said shaping bar and extending over a large portion of the longitudinal extent of said shaping bar, and, by an offset between said at least two elements in a longitudinal direction of said shaping bar at opposite front-side ends of said shaping bar, which offset depends upon a curvature that the round form is to exhibit in the longitudinal direction of said shaping bar, at least one of said at least two elements defines a first end of said shaping bar in the longitudinal direction of said shaping bar and at least another of said at least two elements defines an opposite second end of said shaping bar in the longitudinal direction of said shaping bar, wherein said at least one shoe comprises two clamping parts that are connected to one another via a tightening bolt with said at least two elements positioned between said two camping parts.

20. The panel according to claim 19, wherein said two clamping parts each have a slot such that said at least two elements are positioned between said two clamping parts by being received in said slot of each of said two clamping parts.

21. The panel according to claim 20, wherein said two clamping parts each have a base shank disposed generally parallel to said form skin, with a bore in said base shank of each of said two clamping parts being for passage of said tightening bolt.

22. The panel according to claim 19, wherein said shaping bar includes at least two additional elements held together by said at least one shoe, each of said at least two additional elements being curved along the longitudinal extent of said shaping bar and extending over a large portion of the longitudinal extent of said shaping bar, and wherein an offset between said at least two additional elements in a longitudinal direction of said shaping bar depends upon the curvature that the round form is to exhibit in the longitudinal direction of said shaping bar.

23. The panel according to claim 22, wherein said at least two elements contact one another, said at least two additional elements contact one another, and said one of said at least two elements and said one of said at least two additional elements face one another so as to define a longitudinal opening of said shaping bar.

24. The panel according to claim 19, wherein said at least one shoe comprises plural shoes, with said shaping bar being detachably connected to said vertically extending profile rails via said plural shoes, respectively.

25. The panel according to claim 19, wherein said vertically extending profile rails comprise two profile rails positioned at ends of said form skin, respectively, with each of said two profile rails having a web extending flush with a respective side edge of said form skin.

26. The panel according to claim 19, wherein said vertically extending profile rails further comprise an additional profile rail positioned between said two profile rails.

* * * * *